US006268099B1

(12) United States Patent
Eguchi et al.

(10) Patent No.: US 6,268,099 B1
(45) **Date of Patent: *Jul. 31, 2001**

(54) TONERS, PROCESS FOR THE PREPARATION THEREOF, DEVELOPERS AND METHOD OF FORMING IMAGES

(75) Inventors: Atsuhiko Eguchi; Chiaki Suzuki; Takayoshi Aoki, all of Minami-Ashigara (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/861,738

(22) Filed: May 22, 1997

(30) Foreign Application Priority Data

May 28, 1996 (JP) ..... 8-133703

(51) Int. Cl.[7] ..... G03G 9/097
(52) U.S. Cl. ..... 430/110; 430/111
(58) Field of Search ..... 430/110, 111

(56) References Cited

U.S. PATENT DOCUMENTS 5,124,224 * 6/1992 Berkes et al. ..... 430/110
5,482,812 * 1/1996 Hopper et al. ..... 430/137

FOREIGN PATENT DOCUMENTS

0421416 * 4/1991 (EP) ..... 430/109
52-3304 1/1977 (JP) .
52-3305 1/1977 (JP) .
57-52574 11/1982 (JP) .
58-59455 4/1983 (JP) .
58-63947 4/1983 (JP) .
58-58664 12/1983 (JP) .
59-177570 10/1984 (JP) .
60-3644 1/1985 (JP) .
60-457 1/1985 (JP) .
60-93456 5/1985 (JP) .
60-93457 5/1985 (JP) .
60-151650 8/1985 (JP) .
62-14508 1/1987 (JP) .
63-191817 8/1988 (JP) .
3-17661 1/1991 (JP) .
3-121462 5/1991 (JP) .
4-97163 3/1992 (JP) .
6-67455 3/1994 (JP) .
6-75422 3/1994 (JP) .
7-287413 10/1995 (JP) .

* cited by examiner

*Primary Examiner*—Christopher Rodee
(74) *Attorney, Agent, or Firm*—Oliff & Berridge, PLC

(57) ABSTRACT

Disclosed herein are a toner comprising a binder resin, a coloring agent, and, as a lubricant, a polyethylene wax having a penetration of 5 to 12 dmm and a melt viscosity of less than or equal to 1.5 at 130° C., a process for the preparation thereof, a developer using the toner, and a method of forming images using the toner. According to the present invention, incomplete images in the transfer process can be prevented; excellent flowability is provided and the blocking phenomenon can be prevented; the transfer process can be carried out with less electric consumption. The offset resistance is also good, and the releasability is effectively exhibited at lower temperatures.

5 Claims, 5 Drawing Sheets

UNIT: MM

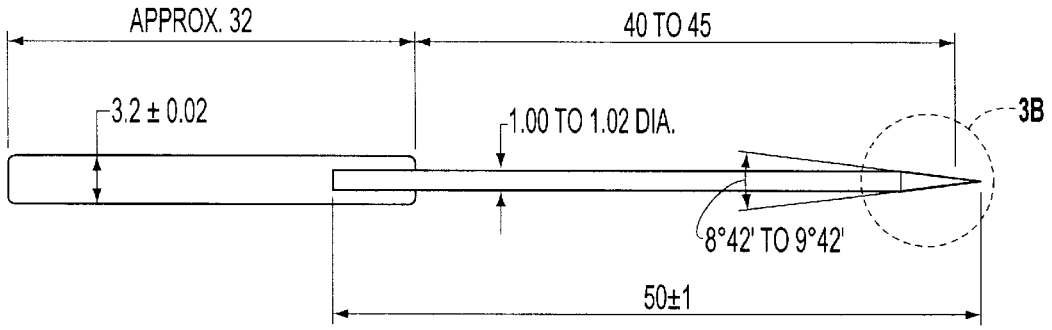
UNIT : MM
FIG. 3A
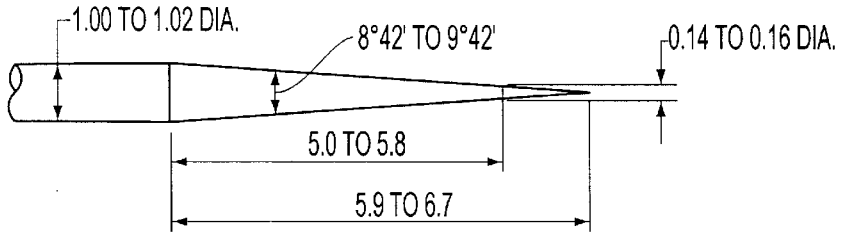
UNIT : MM
FIG. 3B
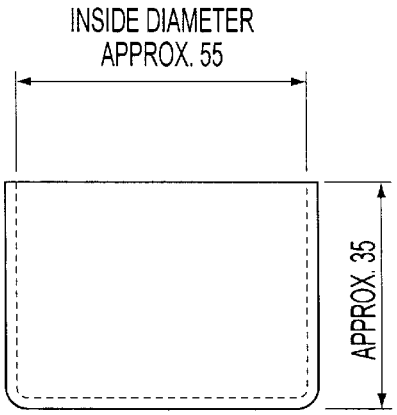
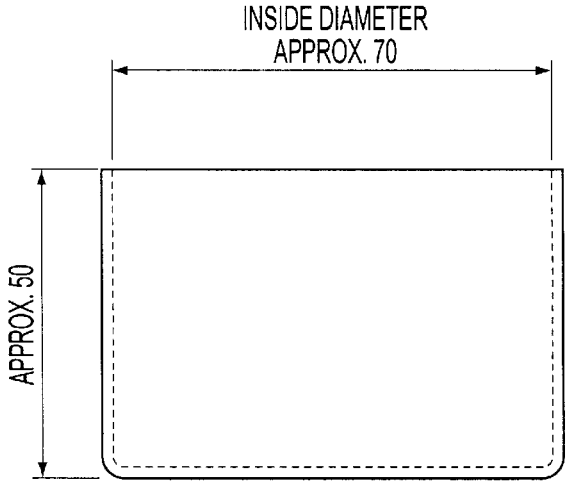
UNIT : MM
FIG. 4A
FIG. 4B

UNIT : MM

UNIT : MM

UNIT : MM

TONERS, PROCESS FOR THE PREPARATION THEREOF, DEVELOPERS AND METHOD OF FORMING IMAGES

BACKGROUND OF THE INVENTION

1. Field of the Invention

The present invention relates to a dry toner used to develop electrostatic latent images in electrophotographic and electrostatic recording processes, a process for the preparation thereof, a developer comprising the said toner, and a method of forming images.

2. Description of the Related Art

In the electrophotographic process, an electrostatic latent image formed on a photoreceptor comprising a photoconductive material is developed by applying a toner onto the electrostatic latent image by means of, e.g., a magnetic brush. The toner on the photoreceptor is transferred onto a transfer medium such as a paper or sheet, and the transferred toner is fixed by means of heat, solvent, pressure or the like to produce an image. To repeatedly provide copied images of high quality, therefore, it is essential for each step to fully operate.

For instance, it is important to generate a uniform electric field near the transfer medium in the transfer step. Conventionally, Corotron method is widely used to generate the electric field due to its simple mechanism and low cost.

However, the Corotron method has various problems: upon electrical discharging, ozone, harmful to humans, is produced; a high voltage power supply is required in the copying process and thus regular maintenance is necessary for cleaning discharge products. Accordingly, a bias roll transfer method capable of solving the above disadvantages has been proposed and studied. In this transfer method, a transfer medium is interposed between a photoreceptor and a bias roll, and a transferring electric field is applied directly to the transfer medium by the bias roll. To transfer a toner, it is necessary that the transfer medium and bias roll are in contact with each other at a linear load of 5 g/cm or higher. When pressure is applied between the transfer medium and bias roll, however, the toner image on the photoreceptor is also pressurized and, consequently, toner particles in the toner image may aggregate and the toner image may adhere or stick to the photoreceptor. As a result, a part of the toner image on the photoreceptor is not transferred onto the transfer medium and"incomplete image", i.e., incomplete image transfer onto the transfer medium, occurs more often.

To prevent such problems, a method for adding finely divided powder treated with a silicone oil or varnish to the surface of toner particles has been proposed (Japanese Patent Application Laid-Open (JP-A) No. 3-121462) . According to this method, the incomplete image problem can be prevented initially but not fully prevented upon prolonged use. In particular, the incomplete image tends to readily occur when plain paper is used as a transfer medium under high temperature, high humidity environments and when an OHP sheet is used as a transfer medium under low temperature, low humidity environments. Such defects are suppressed by an external additive and the toner itself is not fundamentally improved in this method. Thus, it is necessary to prevent the incomplete image by improvement of the actual toner.

In addition to the defect of image quality in the transfer step, various problems in the fixing step following the transfer step must be solved in order to provide copied images of high quality.

The heat melt method is most often used in fixing toner images. In particular, the contact heat roll fixing method has a good thermal efficiency enabling high speed fixing and, therefore, at present it is more widely used in commercial copying machines and printers than the pressure roll fixing method. However, the heat roll fixing method has the following disadvantages or problems.

1) Recently, there has been a strong need for saving electric source in copying machines and printers from the viewpoint of resource saving. Of all the various steps in the whole apparatus, the fixing step consumes most electric source. In particular, the energy, i.e., the electric source required in the heat roll fixing method is significantly larger than the energy expended in the pressure roll fixing method. For saving energy, therefore, it is important to reduce the minimum temperature required to fix the toner (reduction of fixing temperature)

2) Offset phenomena wherein the toner adheres to the heat roll and soils the subsequent copy readily occurs, in particular when the fixing speed is high, and its prevention is desirable (prevention of offset phenomena).

3) Near the fixing roll there is provided a scraper for preventing the transfer medium (usually paper) from winding around the roll after having passed therethrough. If a copying machine is run at a high speed, the stress exerted on the scraper increases and consequently poor scraping or image deficiency at tip portions of the transfer medium by the scraper may occur. It is expected that such disadvantages can be fully obviated even when the fixing temperature is low (improvement of releasability at low temperatures and prevention of scratches by a scraper).

4) When copying the double-sided original, multi-color original or copied images, a toner image of the resulting copy is rubbed by a paper feed roller in an automatic original feeder or copying machine or by the reverse side of an upper copy when superimposed to produce stain or blur resulting in reduction of image quality. A toner which forms images resistant to rubbing is expected (improvement of rubbing resistance).

5) Prevention of reduction of flowability of the toner which causes aggregation (blocking) thereof resulting in lowering storage stability and carrier of toner is another problem (improvement of flowability and prevention of aggregation).

To solve some of these problems, the following attempts to improve toners by improving their components, lubricants and binder resins have been carried out.

For example, addition of low molecular weight polypropylene or polyethylene as a lubricating component of the toner has been proposed: Japanese Patent Application Publication (JP-B) Nos. 52-3304, 52-3305, 57-52574 and 58-58664; and Japanese Patent Application Laid-Open (JP-A) Nos. 58-59455 and 60-151650.

The use of these lubricating components improves to some extent offset resistance, prevention of scratches by the scraper, and rubbing resistance of fixed images but does not improve them satisfactorily. When a low molecular weight polypropylene is added as a lubricant of the toner, the temperature in the fixing step can not be lowered due to the high melting point of the polypropylene. In the case of toners to which a low molecular weight polyethylene is added as a lubricant, on the other hand, the flowability and aggregation resistance of the toners are poor, particularly when the amount of polyethylene added to the toners is increased to improve the offset resistance.

The use of a binder resin having Tg (glass transition temperature) a few dozens lower than Tg of conventionally used binder resins or a low molecular binder resin is effective in reducing the minimum temperature required to fix a toner. However, the range of fixing temperatures will simultaneously be lowered as a whole, resulting in reduction of hot offset resistance. In particular, the increase of the amount of heat per unit time to enable high speed copying causes more readily the offset phenomenon than usual copying. Further, the releasability at low temperatures such as prevention of scratches by a scraper can not be improved.

The use of a wax for improving the releasability at low temperatures together with a binder resin permitting minimum fixing temperature reduction has been proposed. Although polypropylene wax is often used as the wax in view of the balance between the improvability and other properties, its melting point is relatively high at about 145° C., and may cancel the effect of lowering the minimum fixing temperature which effect is provided by the selected binder resin.

Therefore, a lower melting point wax is added together with the binder resin: Japanese Patent Application Laid-Open (JP-A) Nos. 3-17661, 4-97163 and 7-287413. This method is roughly divided in two cases: a wax having a lower melting point in its usual state such as natural wax or the like is added; a polyolefin wax having an artificially reduced melting point is added. In both cases, the effect of lowering the minimum fixing temperature provided by the improvement of a binder resin and/or lubricant is not canceled and the wax can melt at a lower temperature than the minimum fixing temperature of the binder resin. Thus, the releasability in the fixing temperature range can be improved to some extent. However, the wax may readily cause significant reduction of the flowability and aggregation resistance of the toner due to the low molecular weight component contained therein. In the case of the natural or similar wax, the rubbing resistance of copied images after fixing can not be improved to the extent that resistance is improved with the polyolefin wax due to the uneven molecular structure of the former.

To obviate these inconveniences (reduction of flowability or aggregation resistance), the use of a wax having both a low melting point and an average molecular weight within a specific range and a specific molecular weight distribution (free of any low molecular component) has been proposed: Japanese Patent Application Laid-Open (JP-A) Nos. 6-67455 and 6-75422. These method can reduce to some extent the adverse effect of the low melting point toners on the flowability and aggregation resistance. However, some such waxes may rather reduce the releasability at low temperatures unless some other properties of the waxes are sacrificed.

In short, there is a demand for a method of obviating the above problems 1) to 5) in an effective, overall and well balanced way.

SUMMARY OF THE INVENTION

Accordingly, the present invention has been made for the purpose of improving the disadvantages of the prior art in view of the above.

An object of the present invention is to provide a toner capable of preventing the production of defective images in the transfer process.

Another object of the present invention is to provide a toner i) which is excellent in flowability and can prevent the blocking phenomenon and, ii) can be fixed at a lower electric source in the fixing process, in other words, with saving electric source, iii) has good offset resistance, and iv) exhibits effective releasability at lower temperatures.

Another object of the present invention is to provide a toner which can also provide a copied image excellent in rubbing resistance (image fastness) without undergoing damage from the scraper near the fixing roll.

The present invention also aims to provide a process for preparing such a toner, a developer utilizing such a toner, and a method for forming images of high quality by using the said toner.

As a result of their studies, the present inventors have found that the above described disadvantages can be obviated by using, as a lubricant, a polyethylene wax having a penetration within a specific range and a melt viscosity within a specific range at a temperature corresponding to the low temperature fixing range.

The present invention is concerned with a toner comprising a binder resin, a coloring agent and a lubricant, characterized in that the said lubricant is a polyethylene wax having a penetration of 5 to 12 dmm and a melt viscosity at 130° C. of less than or equal to 15 cps.

Thus, by controlling the properties of a polyethylene wax, more particularly by using a polyethylene wax having a hardness and melt viscosity in a specific range which is slightly softer than conventional but does not possess a tackiness that causes aggregation of the toners, the aggregation of toners upon transfer which causes defective images is prevented and the rubbing resistance characteristic of the polyethylene wax itself is maintained. Further, the flowability, aggregation resistance and hot offset resistance properties are not affected and scratches by the scraper can be effectively prevented even in a lower temperature fixing region.

The toner of the present invention may be prepared by melting and kneading a binder resin, a coloring agent, and a lubricant comprising a polyethylene wax having a penetration of 5 to 12 dmm and a melt viscosity at 130° C. of less than or equal to 15 cps.

The melting and kneading of basic components is preferred since the releasability at lower temperatures, flowability of toners and aggregation resistance can be improved with a good balance. Although the reasons therefor are not fully elucidated, it is believed that the lubricant is uniformly dispersed in the toner, so that the lubricant is uniformly dispersed even on the toner surface which has been pulverized when the kneaded composition is pulverized to prepare toner particles, whereby the effect of the lubricant can be exhibited on the whole surface of the toner.

The toner can be combined with a carrier to make a two-component developer of the present invention.

The method of forming images according to the present invention comprises a latent image forming step for forming latent images on a latent image substrate, a developing step for developing the latent images with a developer, a transfer step for transferring the developed images on transfer media, and a fixing step for fixing the transferred images on the transfer media through heat, wherein the developer containing said toner is used as a developer. This method of forming images can provide the above described various advantages.

BRIEF DESCRIPTION OF THE DRAWINGS

FIG. 3A illustrates a needle for the test apparatus shown in FIGS. 2A and 2B.

FIG. 3B illustrates an enlarged view of the tip of the needle of FIG. 3A.

FIGS. 4A and 4B illustrate test sample containers for the test apparatus of FIGS. 2A and 2B.

DETAILED DESCRIPTION OF THE PREFERRED EMBODIMENTS

Figure 1:
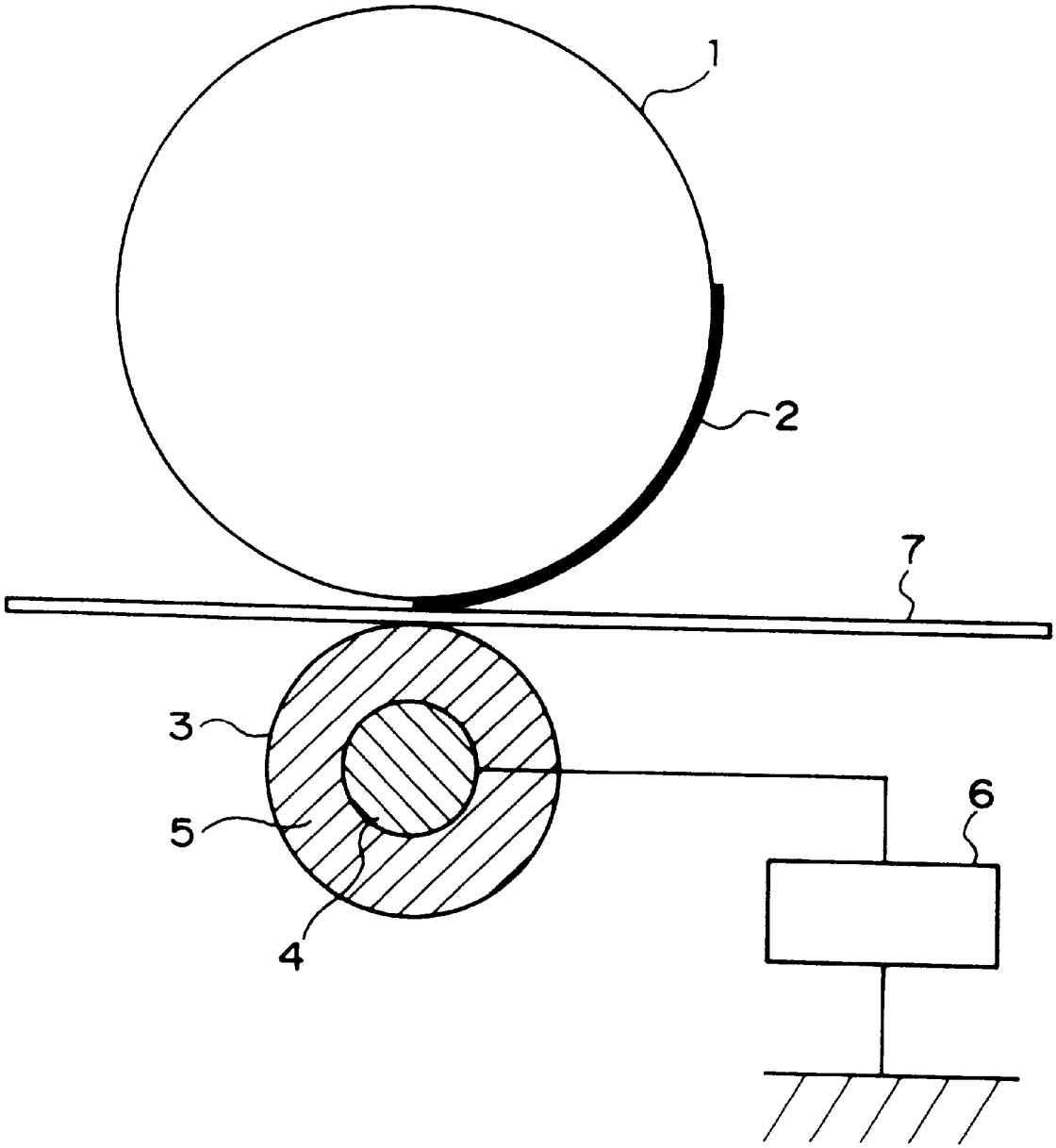
FIG. 1 is a schematic drawing showing an embodiment of the transfer step of the method of forming images according to the present invention.

The preferred embodiments of the present invention will hereinafter be described in detail.

The lubricant used in the toner of the present invention is a polyethylene wax having specific properties. Generally, polyethylenes have melting points lower than those of polypropylenes and are therefore more suited to lowering the minimum fixing temperature. Further, polyethylenes have linear molecular structures and therefore self-lubrication, so that damage of the surface of fixed images through abrasion can be reduced and the occurrence of stain and blur in the fixed images due to rubbing can be prevented. Thus, after an image passes through heating rolls, a polyethylene film is formed on the surface of the fixing images, so that the lubricating effect is fully exhibited.

To obviate totally the scratches by the scraper, hot offset, aggregation upon transfer and/or fixing, and blocking during storage and to also improve the flowability, the polyethylene wax should have a penetration of greater than or equal to 5 dmm which is slightly higher than that of usual polyethylene waxes and less than or equal to 12 dmm, preferably greater than or equal to 6 dmm and less than or equal to 10 dmm. If the penetration is less than 5 dmm, the low temperature fixing and the low temperature releasability, i.e., the prevention of scratches by the scraper, are reduced. If it exceeds 12 dmm, the offset resistance and further the flowability and aggregation resistance of the toner are reduced.

The polyethylene should have a melt viscosity of less than or equal to 15 cps, preferably less than or equal to 10 cps, at 130° C. This requirement functions synergistically with the above mentioned penetration requirement and contributes to suitable control of the fastness of a fixed image immediately after being passed through heat rolls and the melt viscosity of the image surface as well as to effective prevention of scratching or poor release due to excess stress exerted onto the scraper upon release.

The polyethylene wax has a heat absorption peak by a DSC (differential scanning calorimeter) at 70 to 100° C., preferably 80 to 95° C. The toner satisfying the above mentioned requirements for penetration and melt viscosity and having a heat absorption peak in said range shows more suitable melt state of the wax in fixing at a lower temperature region such as about 130° C. Further, the releasability upon such fixing can be further improved. In addition, the aggregation resistance of toner, particularly the blocking resistance and caking resistance with the lapse of time, is superior, since the melting point of the wax is not too low.

Preferably, the polyethylene wax has a weight-average molecular weight Mw of 500 to 1,000, a number-average molecular weight Mn of 500 to 1,000, and a molecular weight distribution Mw/Mn of less than or equal to 1.5.

When the molecular weight falls within the above range, the heat absorption peak can be easily adjusted to the above defined range. Further, when the molecular weight distribution is less than or equal to 1.5, higher and lower molecular weight components in the wax can be reduced to provide a desired melt viscosity. Thus, the blocking by lower molecular weight components which start to melt at lower temperatures, the reduction of flowability at room temperatures, and the reduction of low temperature releasability due to higher molecular weight components contained in the toner which do not melt at low temperature can be more effectively obviated.

The wax must be completely solid in the usual state and completely melt at approximately the set temperature of the fixing roll in a very short period of passing time to function as a lubricant. When the molecular weight distribution is controlled within the above defined range, the difference between the temperature at which the lower molecular weight components start to melt and the temperature at which the higher molecular weight components completely melt can be made smaller than those of usual waxes. Thus, the amount of wax contributing to release (the amount of wax melting at the set temperature of the fixing roll) is larger leading to very good release.

The penetration was herein measured according to JIS K 2207 and the melt viscosity in a Brookfield viscometer by melting a sample at 130° C.

JIS K 2207 summarizes the test method as measuring the depth of penetration of a needle into a test sample kept at a fixed temperature in a thermostatic water bath for a fixed time. JIS K 2207 provides that the test apparatus shall have the construction shown in FIGS. 2A and 2B, consisting of items (1) to (6). Item (1) includes sub-items (a) to (f). Items (1) to (6), including sub-items (a) to (f) for item (1), are described in JIS K 2207 as follows:

(1) Penetrometer (a) Needle The needle 11 shall be of the shape and dimensions (in mm) as shown in FIG. 3, made of stainless steel (SUS 440-C) or equivalent or superior thereto in hardness, attached to the center of a brass stem, and having a mass of 2.5±0.02 g. The roughness of the ground surface of the taper part shall be 0.2 to 0.3 $\mu$m. In FIG. 3B, the deviation at the boundary line of the straight and the conical parts shall be 0.2 mm or under.

(b) Dropping apparatus The apparatus shall have such construction that by pushing the stopper 16, allow the needle 11 with the needle holder 15 and the weight 21 to penetrate into a sample perpendicularly, furthermore, the frictional resistance against penetration shall be extremely small.

(c) Needle holder The needle holder 15 shall be as shown in FIG. 2, and its mass shall be 47.5±0.02 g.

Figure 2A:
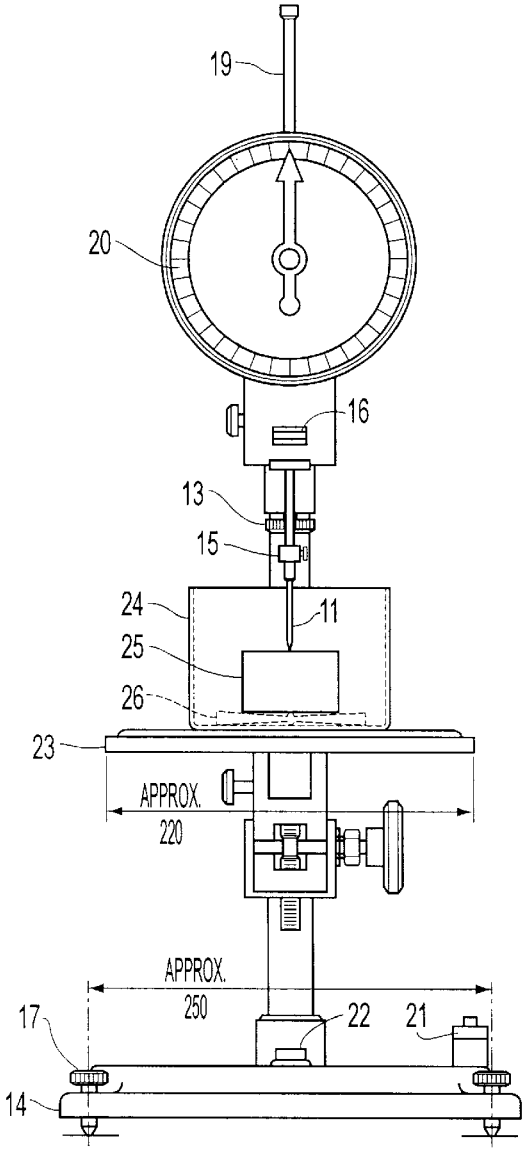
FIGS. 2A and 2B illustrate front and side views of penetration test apparatus as prescribed by a testing standard described herein.
Figure 2B:
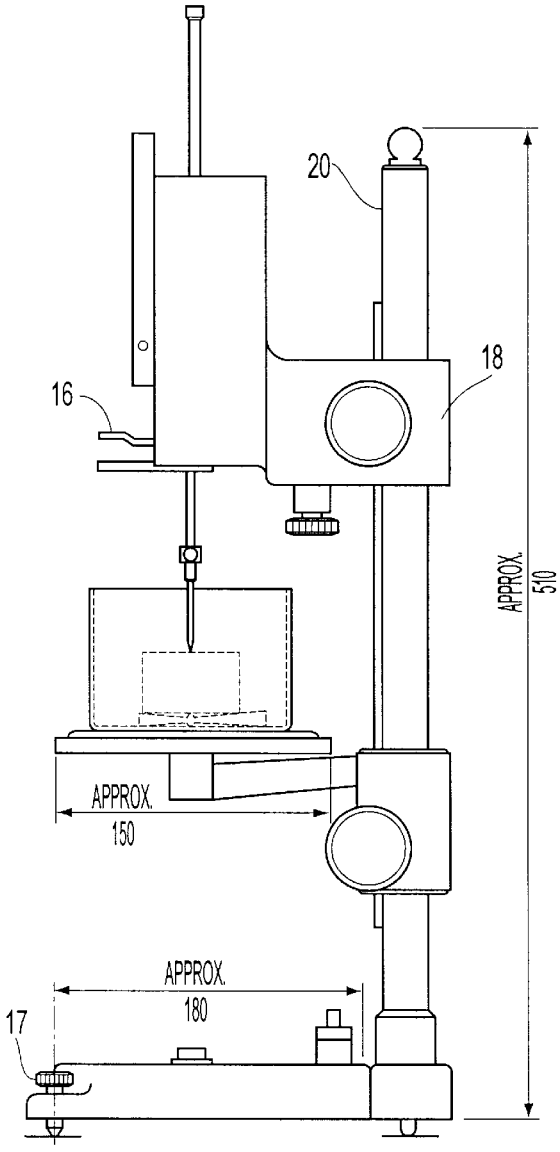

(d) Weight The weight 21 shall be of ring shape to be attached to the needle holder 15 as shown in FIGS. 2A and 2B, made of brass, having a mass of 50±0.05 g.

(e) Dial gauge The dial gauge 12 shall be as shown in FIGS. 2A and 2B and capable of reading the penetration distance to the nearest 0.1 mm, and the rack 19 shall be movable up and down at least 40 mm.

(f) Test table and mounting The mounting 14 shall be provided with a test table 13 which can be moved up and down, a pillar 20 made of metal, a level 22 and adjusting screw for the horizontal 17, and to the pillar 20, an arm 18 for the dial gauge 12 shall be attached, and mechanism 23 for minute adjustment to contact the tip of the needle 11 with the surface of the sample, necessary for testing, shall also be provided.

(2) Sample container The sample container 25 shall be a flat bottomed cylinder, made of metal having the shape and dimensions (in mm) shown in FIG. 4A. For a sample penetration of 200 or over, the container having the shape and dimensions (mm) shown in FIG. 4B shall be used.

Figure 5A:
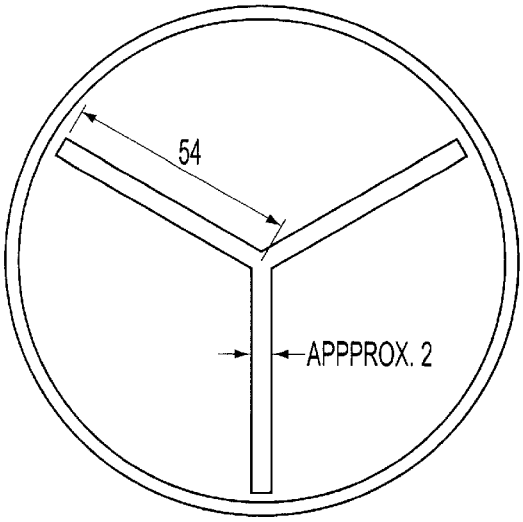
FIGS. 5A and 5B illustrate top and side views of a glass container and tripod-type metal stand for the test apparatus of FIGS. 2A and 2B.
Figure 5B:
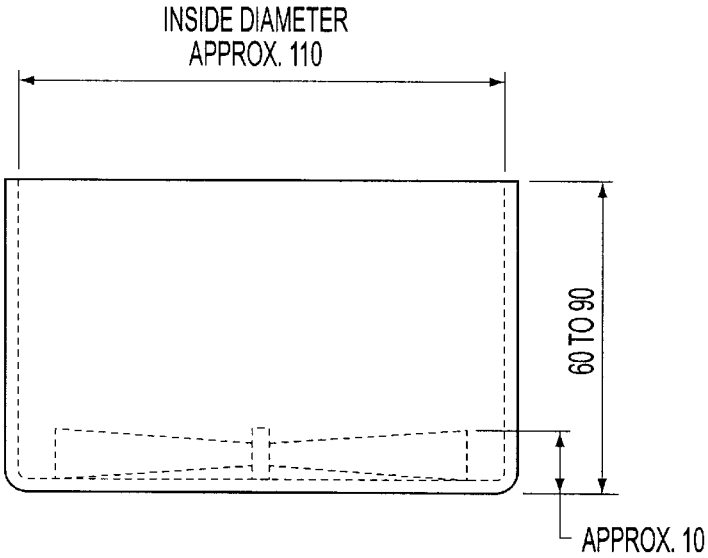
Figure 6:
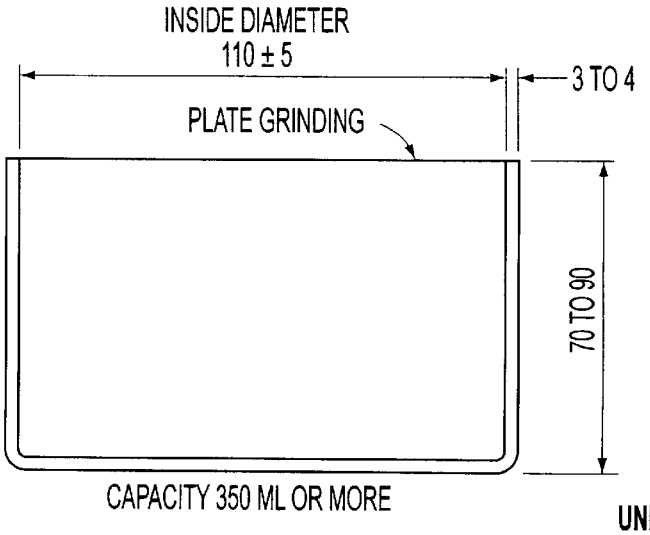
FIG. 6 illustrates a cross section of the glass container of FIGS. 5A and 5B.

(3) Glass Container and Tripod-Type Metallic Stand JIS k 2207 refers to another specification, JIS K 2839, for requirements for the glass container 24. The requirements for the glass container 24 can be summarized as shown in FIG. 6. The units in FIG. 6 are in mm, and glass for the illustrated container 24 is regular grade or superior thereto. The tolerance for dimensions under 10 mm is ±0.5 mm and that for dimensions of 10 mm to 100 mm is +5%. The glass container 24 shall have an internal surface bottom flat to such an extent that when a metallic tripod is placed thereon, it can keep the tripod in a stable state. The tripod-type metallic stand 26 shall have the shape and dimensions (in mm) as shown in FIG. 5, made of brass (with plating).

(4) Thermostatic Water Bath The bath shall be a thermostatic water bath capable of placing the sample container and the glass container in a row and them at a temperature of 25±0.1 degrees C.

(5) Second Watch A stopwatch whose accuracy shall be within ±0.05 percent per 15 minutes, and the minimum graduation shall be 0.1 seconds, or an electric timer or other shall be used.

Figure 7:
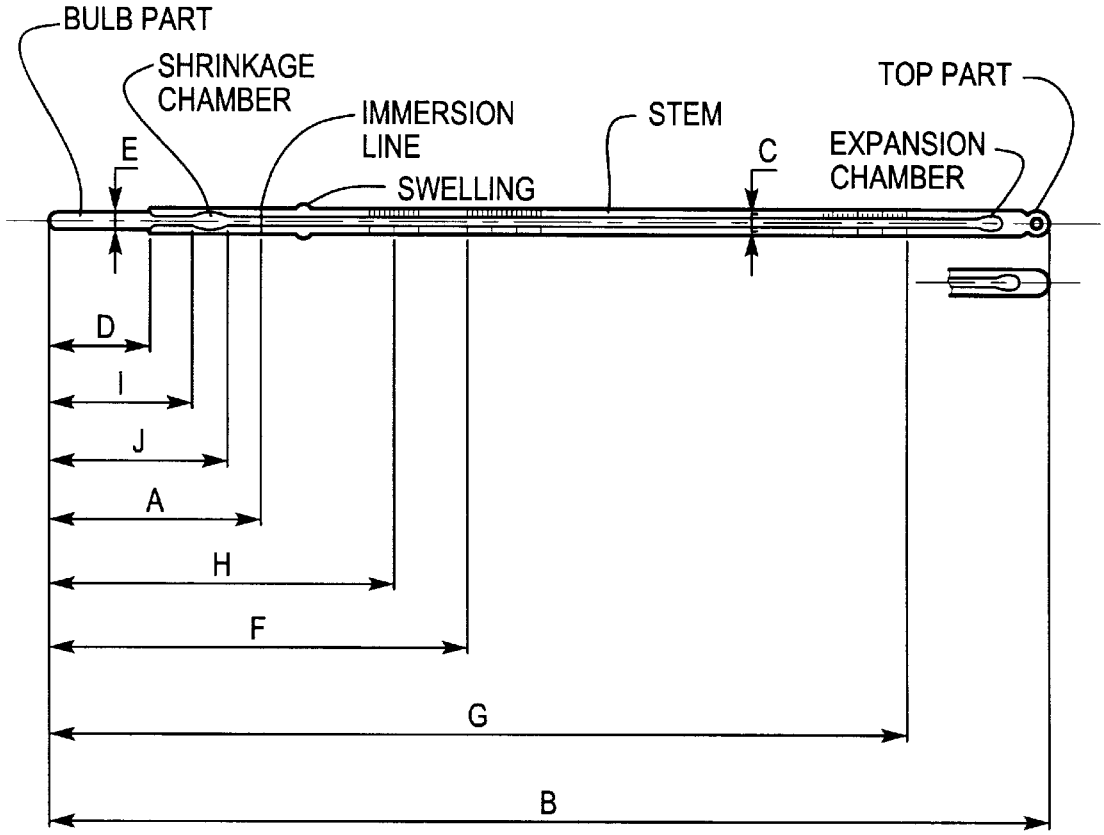
FIG. 7 illustrates a front view of a thermometer.
Figure 8:
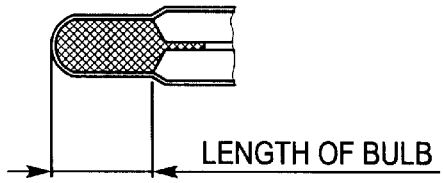
FIG. 8 illustrates an enlarged view of the bulb of the thermometer of FIG. 7.

(6) Thermometer JIS K 2207 refers to another specification, JIS B 7410, for requirements for a thermometer. The requirements can be summarized as a glass mercury type thermometer, as shown in FIGS. 7 and 8. Scale range thereof is from 23.5 to 27.5° C., and scale interval, long scale mark, scale digit, and scale error are respectively, 0.05° C., every 0.1° C. and 0.5° C., every 1° C., and 0.1° C. maximum at 25° C. Test temperature and allowable heating temperature are respectively 25° C. and 105° C. Top shape is annular, overall length B is 305±5 mm, diameter C is 6.5 to 8.0 mm, length D and diameter E of the bulb are 45 to 55 mm, and 6.0 to 7.0 mm, respectively. Distances F and C from the lower end of the bulb to the specified scale mark 137 to 157 mm up to 23.5° C., and 193 to 218 mm up to 27.5° C., respectively. Scale range of ice point is −0.5 to +0.5 ° C. and distance H from the lower end of the bulb to the ice point is 77 to 87 mm. Further, distance I from the lower end of the bulb to the lower end of the chamber is 100 mm minimum, and distance J from the lower end of the bulb to the upper end of the chamber is 125 mm maximum. When used, the whole of the thermometer is kept at the temperature to be measured.

JIS K 2207 provides for sample preparation as follows:

(1) The sample shall be molten by avoiding local overheating and by raising the temperature to no more than 90 degrees C. above the softening point, and at a temperature as low as possible with slow stirring, while avoiding the formation of foam.

(2) When the sample has sufficient fluidity and uniformity, put the sample in a sample container 25. The quantity of the sample shall be such that the depth of the sample shall be at least 10 mm deeper than the expected penetration depth of the needle.

(3) Cover the sample container 25 with a lid for preventing dust contamination, leave it for 1 to 1.5 hours at room temperature between 15 to 30 degrees C. In the case of the sample container 25 of FIG. 4B, leave it for 1.5 to 2 hours. Then place it on the perforated mounting 14 in the thermostatic water bath kept at 25±0.1 degrees C. in a row with the glass container 24 placed in the tripod stand 26, and leave it for 1 to 1.5 hours. When the container 25 of FIG. 4B is used, it shall be left for 1.5 to 2 hours.

JIS K 2207 provides the following test procedure:

(1) Confirm that water drops or foreign substances do not adhere to the needle holder 15, the weight 21, stopper 16, or others. Each time a test is conducted, clean the needle 11 with gauze wetted with trichloroethane or suitable solvent, then wipe the needle 11 with dry gauze in the direction of the needle tip and attach it to the needle holder 15.

(2) Transfer the sample container 25 to the tripod stand 26 of the glass container 24 in the thermostatic water bath, place the glass container 24 on the test table 13 of the penetrometer and filled with water. By properly adjusting a light source, project the shadow of the tip of the needle 11 onto the surface of the sample, and touch the tip of the needle 11 to the surface of the sample by adjusting the height of the test table 13 so as to contact the tip of the needle with its shadow.

(3) Quietly push the rack 19 which is engaged with the pinion of the dial gauge 12 to the upper end of the needle holder 15, adjust the indicator to the 0 point, then press the stopper 16 and allow the needle 11 to penetrate into the sample under its own weight for 5 seconds. For accuracy, it is recommended to start the stopwatch before the test. When the stopwatch indicates an arbitrary graduation, press the stopper 16 and allow the needle 11 to penetrate, then release the stopper 16 after the specified time has elapsed precisely. Press the rack 9 again to the upper end of the holder 15 quietly, read the indication of the dial gauge 12 to the nearest 0.5. If the sample container 25 moves during the measurement, repeat the measurement.

(4) The measurements shall be conducted three times on the sample in the same container 25, and each measuring point shall be spaced at least 10 mm from one another, and from the container's peripheral wall. For tests with samples having a penetration of 200 or more, prepare three needles 11, and don't remove the needles 11 from the sample until the tests have been completed. After each measurement, return the sample and the glass container 24 to the thermostatic water bath, and replenish the water in the glass container 24.

(5) Obtain the difference between the maximum and minimum values measured and the average value of the measured values. If the difference of the maximum and minimum values specified below, round the average value to the nearest integer, and use that for the penetration value.

JIS K 2207 provides that the difference between the maximum and minimum values shall not exceed the tolerance in the table shown below, with respect to the average value of the values measured:

| Average of measured penetrations | Tolerance of measured penetration |
|---|---|
| 0 to 50 excl. | 2.0 |
| 50.0 to 150.0 excl. | 4.0 |
| 150.0 to 250.0 excl. | 6.0 |
| 250 and over | 8.0-- |

The melting point of wax is the temperature at the heat absorption peak as measured by Shimadzu differential scanning calorimeter DSC-50 at a heating rate of 10° C./min. The molecular weight distribution Mw/Mn of wax was measured by gel permeation chromatography GPC150C (available from Waters Corp.) at 140° C. with the use of o-dichlorobenzene as a solvent at a measuring flow rate of 1.0 ml/min for a sample concentration of 0.1% by weight. The molecular weight of a sample was calculated from the viscosity of polyethylene according to the equation. The column used was Tohso GMH-HT (60 cm) connected to GMH-HTL (60 cm).

Suitably, the toner of the present invention is prepared by melting and kneading the binder resin, coloring agent and lubricant. When the toner is prepared by this method, the lubricant polyethylene used in the present invention is dispersed in the toner in the form of some domain. Other methods, for example, the method wherein the polyethylene is previously dispersed in the binder resin during polymerization, are not preferred since the dispersed state of other materials and lubricant are different and the balance between the releasability at lower temperatures and the flowability and aggregation resistance of the toner are poor although the exact reasons therefor are not elucidated.

The binder resin used in the toner of the present invention is not especially limited and may be selected from any materials available in the art, including homo- or copolymers of styrenes, such as styrene, α-methylstyrene, 2-methylstyrene, 3-methylstyrene, 4-methylstyrene, 2,5-dimethylstyrene, 3,4-dimethylstyrene, 2,4,6-trimethylstyrene, 2-ethylstyrene, 3-ethylstyrene, 4-butylstyrene, 4-sec-butylstyrene, 4-tert-butylstyrene, 4-hexylstyrene, 4-nonylstyrene, 4-octylstyrene, 4-phenylstyrene, 4-decylstyrene, 4-dodecylstyrene, 2-chlorostyrene, 3-chlorostyrene, 4-chlorostyrene, 2,4-dichlorostyrene, 3,4-dichlorostyrene, 2-methoxystyrene, 4-methoxystyrene and 4-ethoxystyrene; vinyl esters, such as vinyl acetate, vinyl propionate, vinyl benzoate and vinyl butyrate; acrylic acid esters, such as methyl, ethyl, butyl, sec-butyl, isobutyl, propyl, isopropyl, 2-octyl, dodecyl, stearyl, hexyl, isohexyl, phenyl, 2-chlorophenyl, diethylaminoethyl, 3-methoxybutyl, diethyleneglycol ethoxylate and 2,2,2-trifluoroethyl acrylates; methacrylic acid esters, such as methyl, ethyl, butyl, sec-butyl, isobutyl, propyl, isopropyl, 2-octyl, dodecyl, stearyl, hexyl, decyl, phenyl, 2-chlorohexyl, diethylaminoethyl, 2-hexylethyl and 2,2,2-trifluoroethyl methacrylates; vinyl ethers, such as vinyl methyl ether, vinyl ethyl ether and vinyl butyl ether; and vinyl methyl ketone; polyester resins comprising polyvalent hydroxy compounds, such as ethylene glycol, propylene glycol, 1,4-butanediol, 2,3-butanediol, 1,5-pentanediol, 1,6-hexanediol, neopentyl glycol, 1,4-cyclohexane dimethanol, polypropylen glycol (dipropylene glycol, tripropylene glycol, and the like), bisphenol A and derivatives and alkylene oxide adducts thereof, divalent hydroxy compounds (for example, hydrogenated bisphenol A), and tri- or polyvalent hydroxy compounds (for example, glycerin, sorbitol, 1,4-sorbitan and trimethylolpropane), and polyvalent carboxylic acids, such as malonic acid, succinic acid, glutane 1,2,5-hexanetricarboxylic acid, 1,2,7,8-octanetetracarboxylic acid, n-octylsuccinic acid, 1,3-dicarboxy-2-methyl-2-carboxymethylpropane, tetra (carboxydimethyl)methane, maleic acid, fumaric acid, dodecenylsuccinic acid, 1,2,4-cyclohexanetricarboxylic acid, phthalic acid, isophthalic acid, terephthalic acid, trimellitic acid, piromellitic acid and 1,2,4-naphthalenetricarboxylic acid, or reactive derivatives thereof such as lower alkyl esters, acid anhydrides or acid halides; polyurethanes; epoxy resins; silicone resins; and polyamides.

The coloring agent used as one of the essential components of the toner according to the present invention is also not especially limited and may be selected from any materials available in the art, including carbon black; dyes and pigments, for example, nigrosinedyes, aniline blue, calcoylblue, chrome yellow, ultramarine blue, DuPont Oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1 and C.I. Pigment Blue 15:3; and magnetic materials, such as magnetite and ferrite.

The toner may optionally contain any known additives including charge control agents. Further, finely divided particles of other inorganic compounds, such as flow control agents, including finely divided colloidal silica, may be added to the surface of the toner particles.

The amount of polyethylene wax added is 2 to 20% by weight, preferably 5 to 10% by weight, based on the total weight of the toner. Proportions of other components may be suitably determined by those skilled in the art. Generally, the coloring agent is 5 to 20% by weight based on the total weight of toner. All or almost all of the remainder is the binder resin.

The toner may be used as a one-component developer, a capsule type toner, or a two-component developer in combination with a carrier. The carrier may be any material available in the art and its nature and process for the preparation thereof are not limited. Any of iron powder carriers, ferrite carriers, surface-coated ferrite carriers and magnetic powder dispersion carriers may be used. A carrier coated with a resin on the surface is especially preferred from the viewpoint of charge imparting capacity and durability. In this case, the resin may preferably be a styrenic or acrylic resin, a fluororesin, or a silicone resin.

The method of forming images according to the present invention which uses the above described toner will be described. In the method of forming images according to the present invention, electrostatic latent images are formed on a substrate such as a photoreceptor or electrostatic recording medium electrophotographically or with a needle electrode. The electrostatic latent image substrate may be any one of the conventionally known ones, including Se, organic or amorphous silicon receptors which may optionally have an overcoat on their surface; and electrostatic recording media comprising dielectrics such as polyethylene terephthalate. The electrostatic latent images thus formed are then developed by means of the above described toner. The development may be carried out by either a one-component or a two-component method. The toner images formed by the development are then transferred onto transfer media. The present invention is effectively applied to the transferring method through use of the bias roll.

FIG. 1 illustrates a typical example of the transfer step. In the development step, a toner image 2 is formed on the surface of an electrostatic latent image supporting roll 1. A transfer roll 3 is provided on the opposite to the electrostatic latent image supporting roll 1. The transfer roll 3 comprises a core 4 and a semiconductive elastic layer 5 coating the core 4 and a bias is applied to the core 4 from the electric source 6. The bias is preferably of 0.5 to 30 μA in current and 100 to 2000 V in voltage. The semiconductive elastic layer 5 is preferably formed of an elastic body comprising a resin, such as polyurethane or styrene-butadiene copolymer, in which an electroconductive filler, such as carbon, is dispersed, and having a volume resistivity of $10^5$ to $10^{11}$ Ω·cm. In such a transfer system, a transfer medium 7 such as paper is inserted between the electrostatic latent image supporting roll 1 and the transfer roll 3 and the toner image 2 is transferred on the transfer medium 7. After transfer, a copy is obtained through a fixing step. In particular, the toner of the present invention is effective for a fixing step using a heat roll.

Toners remaining on the surface of the electrostatic latent image supporting roll 1 are cleaned by any of conventionally known means.

EXAMPLES

The present invention is further illustrated in more detail byway of the following examples and comparative examples but not limited thereto. In the following, the word"parts" signifies parts by weight.

Apparatuses (Fuji Xerox Co., Ltd.) and conditions for the reconstruction thereof used in the following examples and comparative examples are as shown in Table 1.

TABLE 1

| Developing method | Apparatus used | Electric source used | Transfer current/voltage | Linear load |
|---|---|---|---|---|
| One-component | Vivace 200 reconstructed | Constant current source | −3.5 μA | 20 g/cm |
| One-component | Able 3015 reconstructed | Constant current source | +3.5 μA | 20 g/cm |
| Two-component | Vivace 550 reconstructed | Constant current source | −400 V | 20 g/cm |
| Two-component | FX-5039 reconstructed | Constant current source | +400 V | 20 g/cm |

The physical properties of waxes used in the examples and comparative examples are shown in Table 2. These properties were measured by the methods as described hereinbefore.

TABLE 2

| Wax | | Penetration | Melt viscosity* | Melting point | Molecular weight | | |
|---|---|---|---|---|---|---|---|
| No. | Kind of wax | (dmm) | (cps) | (° C.) | Mw | Mn | Mw/Mn |
| 1 | Polyethylene | 6.0 | 8.8 | 87.7 | 680 | 632 | 1.08 |
| 2 | Polyethylene | 8.0 | 10.5 | 91.3 | 762 | 675 | 1.13 |
| 3 | Polyethylene | 10.0 | 8.1 | 82.1 | 793 | 586 | 1.34 |
| 4 | Polyethylene | 5.0 | 13.9 | 96.3 | 921 | 758 | 1.21 |
| 5 | Polyethylene | 2.0 | 25.3 | 116.1 | 1100 | 580 | 1.91 |
| 6 | Polyethylene | 2.4 | 239.7 | 125.4 | 4600 | 1500 | 3.07 |
| 7 | Polyethylene | 4.0 | 133.4 | 114.2 | 3320 | 720 | 4.61 |
| 8 | Polyethylene | 25.0 | 28.6 | 110 | 1420 | 550 | 2.58 |
| 9 | Polypropylene | 1.0 | 192.3 | 142.6 | 8120 | 2980 | 2.72 |
| 10 | Fisher-Tropsch | 1.0 | 12.2 | 106.8 | 912 | 553 | 1.65 |
| 11 | Fisher-Tropsch | 4.0 | 10.6 | 85.0 | 673 | 456 | 1.48 |
| 12 | Polyethylene | 5.0 | 16.3 | 106.2 | 916 | 568 | 1.61 |

*As measured at 130° C.

Example 1

Preparation of Toner

| | |
|---|---|
| Styrene-butyl methacrylate (85/15 weight ratio) copolymer (Mw = $1.8^{*}10^{5}$) | 100 parts |
| Carbon black (Regal330: Cabot Co.) | 10 |
| Charge control agent (P-51: Orient Chemical Industries) | 2 |
| Polyethylene wax shown as No. 1 | 5 |

The above components were melted and kneaded in a Banbury mixer and the resultant composition was cooled, then pulverized in a jet mill, and classified to yield toner particles having an average particle size of 10 μm.

Preparation of Carrier

Ferrite particles of 85 μm were used as the carrier.

Preparation of Developer

Three (3) parts of the above toner and 97 parts of the above carrier were mixed to prepare a developer composition.

Example 2

The procedures of Example 1 were repeated except that the polyethylene wax shown as No. 2 was used as a lubricant to yield a developer composition.

Example 3

The procedures of Example 1 were repeated except that the polyethylene wax shown as No. 4 was used as a lubricant to yield a developer composition.

Example 4

The procedures of Example 1 were repeated except that the polyethylene wax shown as No. 12 was used as a lubricant to yield a developer composition.

Comparative Example 1

The procedures of Example 1 were repeated except that the polyethylene wax shown as No. 5 was used as a lubricant to yield a developer composition.

Comparative Example 2

The procedures of Example 1 were repeated except that the polyethylene wax shown as No. 6 was used as a lubricant to yield a developer composition.

Comparative Example 3

The procedures of Example 1 were repeated except that the polyethylene wax shown as No. 7 was used as a lubricant to yield a developer composition.

Comparative Example 4

The procedures of Example 1 were repeated except that the polypropylene wax shown as No. 9 was used as a lubricant to yield a developer composition.

Comparative Example 5

The procedures of Example 1 were repeated except that the modified Fisher-Tropsch wax (similar to natural wax) shown as No. 10 was used as a lubricant to yield a developer composition.

Example 5

Preparation of Toner

| | |
|---|---|
| Styrene-butyl acrylate (80/20 weight ratio) copolymer (Mw = $1.5\times10^5$) | 100 parts |
| Magnetic powder (EPT-1000: Toda Kogyo KK) | 100 |
| Charge control agent (TRH: Hodogaya Chemical) | 2 |
| Polyethylene wax shown as No. 1 | 5 |

The above components were mixed in a Henschel mixer, heated, melted and kneaded in an extruder, and the resultant composition was cooled, then pulverized in a jet mill, and classified to yield toner particles having an average particle size of 10 μm. A hundred (100) parts of these toner particles and 0.5 parts of hydrophobic silica fine particles of 0.012 μm in primary particle size were mixed in a Henschel mixer to prepare a one-component developer composition.

Example 6

The procedures of Example 5 were repeated except that the polyethylene wax shown as No. 3 was used as a lubricant to yield a developer composition.

Comparative Example 6

The procedures of Example 5 were repeated except that the polyethylene wax shown as No. 5 was used as a lubricant to yield a developer composition.

Comparative Example 7

The procedures of Example 5 were repeated except that the polyethylene wax shown as No. 8 was used as a lubricant to yield a developer composition.

Comparative Example 8

The procedures of Example 5 were repeated except that the modified Fisher-Tropsch wax shown as No. 11 was used as a lubricant to yield a developer composition.

The developers obtained in Examples 1 to 6 and Comparative Examples 1 to 8 were used to evaluate properties. The results are shown in Table 3.

TABLE 3

| | Temperature at which scratches by scraper disappear (° C.) | Storage stability | Amount of toner conveyed (kg/h) | Rubbing resistance | Offset temperature (° C.) |
|---|---|---|---|---|---|
| Ex. 1 | No occurrence | G1 | 2.4 | G0 | No occurence |
| Ex. 2 | No occurrence | G1 | 2.5 | G1 | No occurrence |
| Ex. 3 | No occurrence | G1 | 2.5 | G0 | No occurrence |
| Ex. 4 | 124 | G1 | 2.2 | G1 | No occurrence |
| Comp. Ex. 1 | 144 | G3 | 0.9 | G1 | 209 |
| Comp. Ex. 2 | 168 | G2 | 1.1 | G0 | 215 |
| Comp. Ex. 3 | 156 | G2 | 1.7 | G1 | 227 |

TABLE 3-continued

| | Temperature at which scratches by scraper disappear (° C.) | Storage stability | Amount of toner conveyed (kg/h) | Rubbing resistance | Offset temperature (° C.) |
|---|---|---|---|---|---|
| Comp. Ex. 4 | 163 | G1 | 1.9 | G3 | No occurrence |
| Comp. Ex. 5 | 137 | G3 | 1.5 | G2 | 229 |
| Ex. 5 | No occurrence | G1 | 3.7 | G0 | No occurrence |
| Ex. 6 | No occurrence | G1 | 3.9 | G1 | No occurrence |
| Comp. Ex. 6 | 141 | G3 | 1.6 | G0 | 211 |
| Comp. Ex. 7 | 138 | G2 | 2.4 | G1 | 219 |
| Comp. Ex. 8 | 132 | G2 | 2.7 | G2 | 226 |

Ex.: Example
Comp. Ex.: Comparative Example

The test methods and criteria for estimating the properties are as follows:

(1) Temperature at which scratches by scraper disappear

By using a fixing apparatus of a vivace 550 (reconstructed) the temperature of the heat roll was measured at which scratches by a scraper produced at tip portions of solid black images reached a level causing practically almost no problems."No occurrence" means that no scratch by the scraper was produced even at 120° C. which is the lowest measurable temperature.

(2) Storage Stability

After allowing a developer composition to stand at 50° C., 50% RH for 17 hours, it was subjected to vibrating sieve of 63 μm for 5 minutes to estimate the blocking resistance according to the following criteria:

G1: greater than or equal to 70% passing through 63 μm sieve

G2: greater than or equal to 40% and less than 70% passing through 63 μm sieve

G3: less than 40% passing through 63 μm sieve.

(3) Amount of Toner Conveyed

Using a toner box of a vivace 800 (reconstructed), the amount of toner conveyed per unit time was measured as an index of flowability.

(4) Rubbing Resistance

Five originals were fed into an automatic original feeder of a vivace 550 (reconstructed) and stains of the back sides of the second and subsequent copies were estimated visually according to the following criteria (G0 and G1 are practically usable):

G0: No occurrence of stains on the back

G1: Some stains which are difficult to confirm visually occurred G2: Stains which can be confirmed visually occurred G3: Significant stains which can be confirmed visually occurred.

(5) Offset Temperature

Using a fixing apparatus of a vivace 550 (reconstructed), the heat roll temperature was raised from 160° C. at 5° C. intervals to 250° C. and the temperature at which offset occurred was confirmed visually. "No occurrence" means that no offset was confirmed at 250° C.).

Example 7

Preparation of Toner

| | |
|---|---|
| Styrene-butyl acrylate (85/15 weight ratio) copolymer ($Mw = 1.6 \times 10^5$) | 100 parts |
| Carbon black (Regal330: Cabot Co.) | 10 |
| Charge control agent (P-51: Orient Chemical Industries) | 2 |
| Polyethylene wax shown as No. 1 | 5 |

The above components were melted and kneaded in a Banbury mixer and the resultant composition was cooled, then pulverized in a jet mill, and classified to yield toner particles having an average particle size of 10 $\mu$m. A hundred (100) parts of the toner particles and 1 part of finely divided titanium oxide powder of 0.015 $\mu$m in average primary particle size were mixed in a Henschel mixer to prepare a toner.

Preparation of Carrier

A carrier was prepared by coating a silicone resin onto grains of ferrite core of 85 $\mu$m.

Preparation of Developer

Three (3) parts of the above toner and 97 parts of the above carrier were mixed to prepare a two-component developer composition.

Example 8

The procedures of Example 7 were repeated except that the polyethylene wax shown as No. 3 was used as a lubricant to yield a developer composition.

Example 9

The procedures of Example 7 were repeated except that the polyethylene wax shown as No. 4 was used as a lubricant to yield a developer composition.

Comparative Example 9

The procedures of Example 7 were repeated except that the polyethylene wax shown as No. 5 was used as a lubricant to yield a developer composition.

Comparative Example 10

The procedures of Example 7 were repeated except that the polyethylene wax shown as No. 8 was used as a lubricant to yield a developer composition.

Comparative Example 11

The procedures of Example 7 were repeated except that the polypropylene wax shown as No. 9 was used as a lubricant to yield a developer composition.

Comparative Example 12

The procedures of Example 7 were repeated except that the Fisher-Tropsch wax shown as No. 10 was used as a lubricant to yield a developer composition.

Example 10

Preparation of Toner

| | |
|---|---|
| Styrene-butyl acrylate (85/15 weight ratio) copolymer ($Mw = 1.7 \times 10^5$) | 100 parts |
| Carbon black (Black pearls 1300: Cabot Co.) | 10 |
| Charge control agent (TRH: Hodogaya Chemical) | 2 |
| Polyethylene wax shown as No. 1 | 5 |

The above components were melted and kneaded in a Banbury mixer and the resultant composition was cooled, then pulverized in a jet mill, and classified to yield toner particles having an average particle size of 10 $\mu$m. A hundred (100) parts of the toner particles and 0.5 parts of finely divided hydrophobic silica powder of 0.012 $\mu$m in average primary particle size were mixed in a Henschel mixer to prepare a toner.

Preparation of Carrier

A carrier was prepared by coating a polymethylmethacrylate resin on grains of ferrite core of 85 $\mu$m.

Preparation of Developer

Three (3) parts of the above toner and 97 parts of the above carrier were mixed to prepare a two-component developer composition.

Comparative Example 13

The procedures of Example 10 were repeated except that the polyethylene wax shown as No. 6 was used as a lubricant to yield a developer composition.

Comparative Example 14

The procedures of Example 10 were repeated except that the polyethylene wax shown as No. 7 was used as a lubricant to yield a developer composition.

The developers obtained in Examples 7 to 9 and Comparative Examples 9 to 12 were fed into a reconstructed vivace 550 (Fuji Xerox Co., Ltd.) to estimate the occurrence of incomplete images.

Also, the developers obtained in Example 10 and Comparative Examples 13 and 14 were fed into a reconstructed FX-5039 (Fuji Xerox Co., Ltd.) to estimate the occurrence of incomplete images.

The test methods and criteria are as follows: Occurrence of incomplete images

The original comprising 1500 images such as Chinese characters and letters of the alphabet was copied fifty thousand (50,000) times under high temperature, high humidity (30° C., 90% RH) and low temperature, low humidity (10° C., 20% RH) to observe the occurrence of incomplete images.

The occurrence of less than or equal to 20% is a practically usable level.

Further, the developers obtained by Examples 7 to 10 and Comparative Examples 9 to 14 were used to estimate the properties as described above.

The results are shown in Table 4.

TABLE 4

| | Occurrence of incomplete images (%) | | Temperature at which scratches | | | Amount of toner | Offset |
|---|---|---|---|---|---|---|---|
| | High temperature high humidity | Low temperature low humidity | by scraper disappear (° C.) | Rubbing resistance | Storage stability | conveyed (kg/h) | temperature (° C.) |
| Ex. 7 | 16 | 15 | No occurrence | G0 | G1 | 2.6 | No occurrence |
| Ex. 8 | 18 | 15 | No occurrence | G1 | G1 | 2.5 | No occurrence |
| Ex. 9 | 15 | 13 | No occurrence | G0 | G1 | 2.5 | No occurrence |
| Comp. Ex. 9 | 86 | 75 | 140 | G1 | G3 | 0.9 | 213 |
| Comp. Ex. 10 | 81 | 69 | 134 | G2 | G2 | 1.2 | 225 |
| Comp. Ex. 11 | 73 | 58 | 162 | G3 | G1 | 2.0 | No occurrence |
| Comp. Ex. 12 | 63 | 54 | 138 | G2 | G3 | 1.6 | 231 |
| Ex. 10 | 17 | 14 | No occurrence | G0 | G1 | 2.4 | No occurrence |
| Comp. Ex. 13 | 81 | 70 | 164 | G0 | G2 | 1.3 | 215 |
| Comp. Ex. 14 | 61 | 53 | 153 | G1 | G2 | 1.1 | 230 |

Ex.: Example
Comp. Ex.: Comparative Example

Example 11

Preparation of Toner

| | |
|---|---|
| Styrene-butyl acrylate (80/20 weight ratio) copolymer (Mw = $1.5\times10^5$) | 100 parts |
| Magnetic powder (EPT-1000: Toda Kogyo KK) | 100 |
| Charge control agent (P-51: Orient Kagaku) | 2 |
| Polyethylene wax shown as No. 1 | 5 |

The above components were mixed in a Henschel mixer, heated, melted and kneaded in an extruder, and the resultant composition was cooled, then pulverized in a jet mill, and classified to yield toner particles having an average particle size of 10 $\mu$m. A hundred (100) parts of these toner particles and 0.3 parts of finely divided hydrophobic silica powder of 0.012 $\mu$m in primary particle size were mixed in a Henschel mixer to prepare a one-component developer composition.

Comparative Example 15

The procedures of Example 11 were repeated except that the polyethylene wax shown as No. 5 was used as a lubricant to yield a developer composition.

Comparative Example 16

The procedures of Example 11 were repeated except that the polyethylene wax shown as No. 8 was used as a lubricant to yield a developer composition.

Comparative Example 17

The procedures of Example 11 were repeated except that the Fisher-Tropsch wax shown as No. 10 was used as a lubricant to yield a developer composition.

Example 12

Preparation of Toner

| | |
|---|---|
| Styrene-butyl acrylate (80/20 weight ratio) copolymer (Mw = $1.6\times10^5$) | 100 parts |
| Magnetic powder (EPT-1000: Toda Kogyo KK) | 100 |
| Charge control agent (TRH: Hodogaya Chemical) | 2 |
| Polyethylene wax shown as No. 1 | 5 |

The above components were mixed in a Henschel mixer, heated, melted and kneaded in an extruder, and the resultant composition was cooled, then pulverized in a jet mill, and classified to yield toner particles having an average particle size of 10 $\mu$m. A hundred (100) parts of these toner particles and 0.5 parts of finely divided hydrophobic silica powder of 0.012 $\mu$m in primary particle size were mixed in a Henschel mixer to prepare a one-component developer composition.

Example 13

The procedures of Example 12 were repeated except that the polyethylene wax shown as No. 2 was used as a lubricant to yield a developer composition.

Example 14

The procedures of Example 12 were repeated except that the polyethylene wax shown as No. 3 was used as a lubricant to yield a developer composition.

Comparative Example 18

The procedures of Example 12 were repeated except that the polyethylene wax shown as No. 6 was used as a lubricant to yield a developer composition.

Comparative Example 19

The procedures of Example 12 were repeated except that the polyethylene wax shown as No. 7 was used as a lubricant to yield a developer composition.

Comparative Example 20

The procedures of Example 12 were repeated except that the polypropylene wax shown as No. 9 was used as a lubricant to yield a developer composition.

The developers obtained in Example 11 and Comparative Examples 15 to 17 were fed into a reconstructed vivace 200 in order to evaluate the occurrence of incomplete images.

Also, the developers obtained in Examples 12 to 14 and Comparative Examples 18 to 20 were fed into a reconstructed Able 3015 in order to evaluate the occurrence of incomplete images.

The test methods and criteria are as described above.

Further, the developers obtained in Examples 11 to 14 and Comparative Examples 15 to 20 were used to estimate the properties in the above described manner.

The results are shown in Table 5.

TABLE 5

| | Occurrence of incomplete images (%) | | Temperature at which scratches | | | Amount of toner | Offset |
|---|---|---|---|---|---|---|---|
| | High temperature high humidity | Low temperature low humidity | by scraper disappear (° C.) | Rubbing | Storage | conveyed (kg/h) | temperature (° C.) |
| Ex. 11 | 16 | 14 | No occurrence | G0 | G1 | 3.7 | No occurrence |
| Comp. Ex. 15 | 82 | 67 | 143 | G1 | G3 | 1.5 | 215 |
| Comp. Ex. 16 | 78 | 62 | 132 | G2 | G2 | 1.9 | 221 |
| Comp. Ex. 17 | 61 | 49 | 136 | G2 | G2 | 2.6 | 230 |
| Ex. 12 | 15 | 15 | No occurrence | G0 | G1 | 3.8 | No occurrence |
| Ex. 13 | 18 | 15 | No occurrence | G1 | G1 | 3.5 | No occurrence |
| Ex. 14 | 19 | 16 | No occurrence | G1 | G1 | 3.2 | No occurrence |
| Comp. Ex. 18 | 79 | 65 | 158 | G0 | G3 | 1.9 | 211 |
| Comp. Ex. 19 | 58 | 46 | 149 | G1 | G2 | 1.7 | 229 |
| Comp. Ex. 20 | 62 | 53 | 164 | G3 | G1 | 2.8 | No occurrence |

Ex.: Example
Comp. Ex.: Comparative Example

Clearly, from the above Tables, the Examples of the present invention show well-balanced, excellent properties as compared with the Comparative Examples.

What is claimed is:

1. A toner comprising a binder resin, a coloring agent and a lubricant, wherein said lubricant is a linear polyethylene wax having a penetration as measured by JIS K 2207 of 5 to 12 dmm, and a melt viscosity of less than or equal to 15 cps at 130° C., a heat absorption peak by DSC of 70 to 100° C., a weight-average molecular weight of 500 to 1000, a number-average molecular weight of 586 to 1000, and a molecular weight distribution as defined by the weight-average molecular weight divided by the number-average molecular weight of less than or equal to 1.5.

2. The toner of claim 1, wherein the content of said lubricant is 2 to 20% of the total weight of toner.

3. A developer comprising a carrier and a toner, wherein said toner comprises a binder resin, a coloring agent, and, as a lubricant, a linear polyethylene wax having a penetration as measured by JIS K 2207 of 5 to 12 dmm, a melt viscosity of less than or equal to 15 cps at 130° C., a heat absorption peak by DSC of 70 to 100° C., a weight-average molecular weight of 500 to 1000, a number-average molecular weight of 586 to 1000, and a molecular weight distribution as defined by the weight-average molecular weight divided by the number-average molecular weight of less than or equal to 1.5.

4. The developer of claim 3, wherein said carrier is coated with a resin.

5. The developer of claim 3, wherein the content of said lubricant is 2 to 20% of the total weight of toner.

* * * * *